US006354727B1

(12) United States Patent
Toyoda et al.

(10) Patent No.: US 6,354,727 B1
(45) Date of Patent: Mar. 12, 2002

(54) MIXING DEVICE

(75) Inventors: Kouji Toyoda; Hiroyuki Yamashita; Hideichi Nitta; Kenji Tanaka, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/403,283

(22) PCT Filed: Apr. 22, 1998

(86) PCT No.: PCT/JP98/01831

§ 371 Date: Oct. 19, 1999

§ 102(e) Date: Oct. 19, 1999

(87) PCT Pub. No.: WO98/48928

PCT Pub. Date: Nov. 5, 1998

(30) Foreign Application Priority Data

Apr. 28, 1997 (JP) ..... 9-124875

(51) Int. Cl.[7] ..... B01F 13/02
(52) U.S. Cl. ..... 366/102; 366/107
(58) Field of Search ..... 366/102, 103, 366/104, 312, 313, 325.1, 325.5, 106, 107; 241/15, 18, 47, 57, 98

(56) References Cited

U.S. PATENT DOCUMENTS

| | | | | |
|---|---|---|---|---|
| 3,645,813 A | * | 2/1972 | Pelikan et al. | 366/325.1 |
| 4,037,794 A | * | 7/1977 | Melliger | 241/57 |
| 4,111,371 A | * | 9/1978 | Melliger | 241/18 |
| 4,214,376 A | * | 7/1980 | Lucke et al. | 366/313 |
| 4,295,925 A | | 10/1981 | Bentvelzen et al. | |
| 4,390,285 A | * | 6/1983 | Durr et al. | 366/102 |
| 4,772,193 A | * | 9/1988 | Glatt | 366/102 |
| 5,289,978 A | * | 3/1994 | Lundquist | 241/57 |

FOREIGN PATENT DOCUMENTS

| | | | |
|---|---|---|---|
| CA | 670869 | * 9/1963 | |
| DE | 1102534 | * 3/1961 | 366/313 |
| DE | 2219352 | 11/1973 | |
| DE | 25 38 267 | * 4/1976 | |
| DE | 2615506 | 10/1977 | |
| DE | 2730598 | 1/1979 | |
| DE | 3120260 | 6/1982 | |
| DE | 3226861 | 1/1994 | |
| GB | 1075741 | 7/1967 | |
| GB | 1369269 | 10/1974 | |
| JP | 4216116 | 9/1942 | |
| JP | 5141654 | 10/1976 | |
| JP | 5924878 | 6/1984 | |
| JP | 5-36493 | 9/1993 | |
| JP | 5161621 | 9/1995 | |
| JP | 9-150046 | 6/1997 | |

OTHER PUBLICATIONS

English Translation to DE2615506A1, Oct. 20, 1977, Germany.
English Translation to DE2219352, Nov. 8, 1973, Germany.
English Translation to DE3226861A1, Jan. 19, 1994, Germany.
English Translation to DE2730598A1, Jan. 25, 1979, Germany.
English Translation to DE3120260A1, Jun. 16, 1982, Germany.

* cited by examiner

*Primary Examiner*—Tony G. Soohoo
(74) *Attorney, Agent, or Firm*—Birch, Stewart, Kolasch & Birch, LLP

(57) ABSTRACT

A mixing method and apparatus in which, a gas for conditioning the physical properties o the material being mixed is ejected forwardly of the direction of rotation of a stirring member from within the material being mixed, when stirring the material to be mixed with the stirring member which rotates around an axis inside a vessel.

6 Claims, 12 Drawing Sheets

Fig.9 ( 1 )
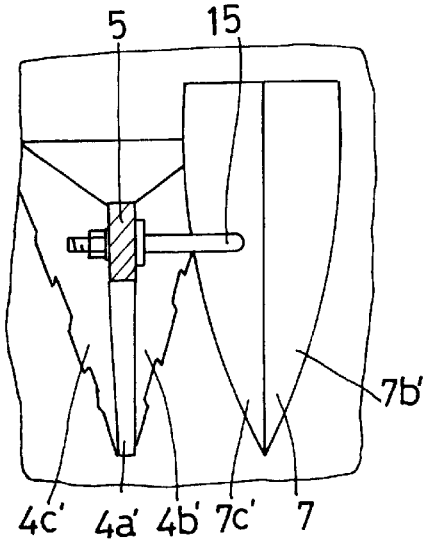
Fig.9 ( 2 )
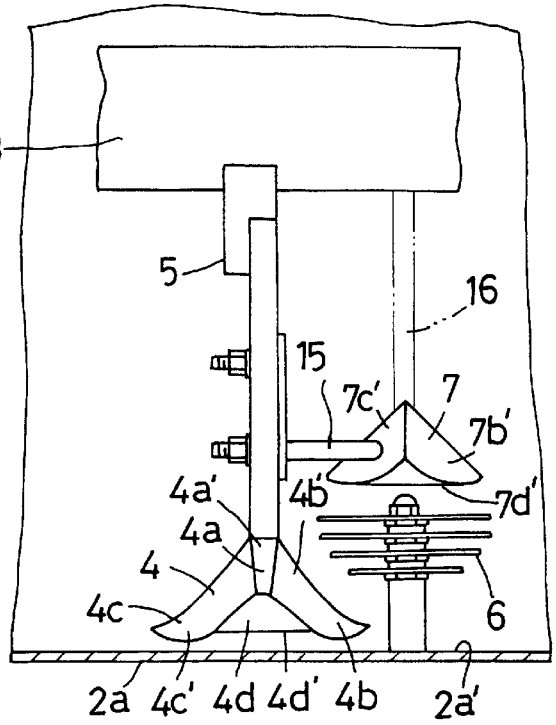
Fig.9 ( 3 )
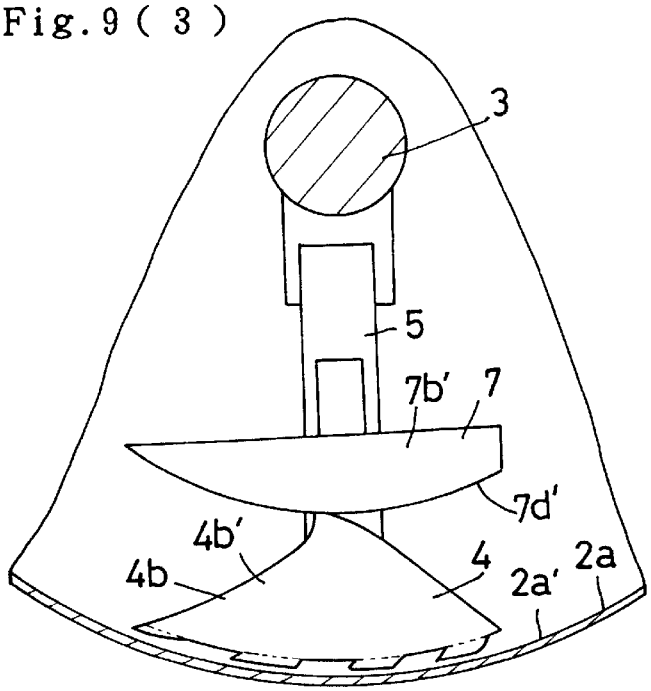

Fig.10 ( 1 )
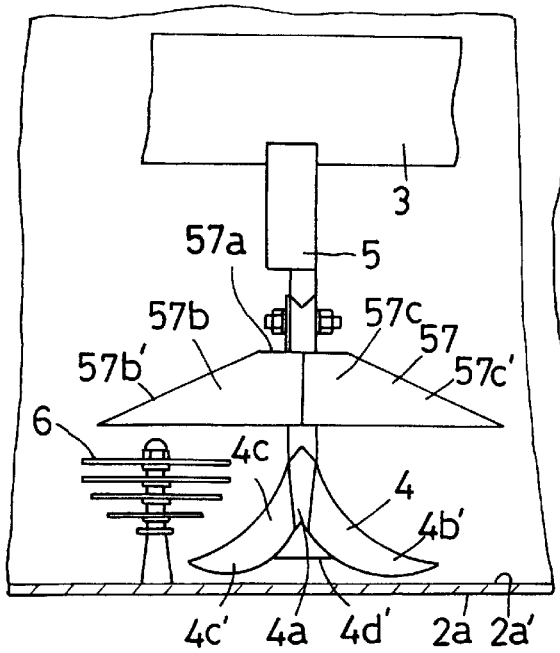
Fig.10 ( 3 )
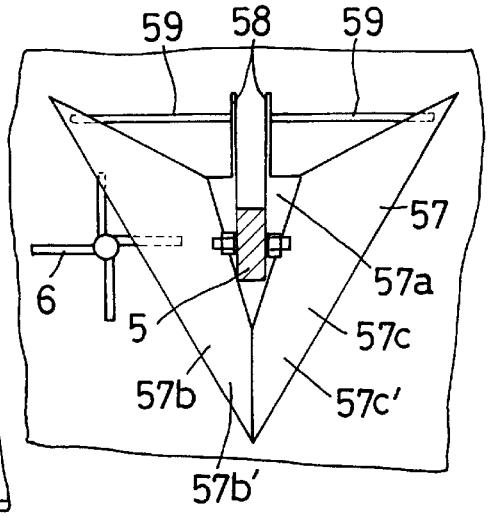
Fig.10 ( 4 )
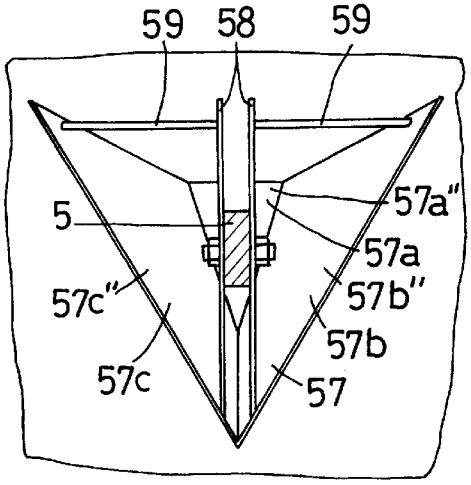
Fig.10 ( 2 )
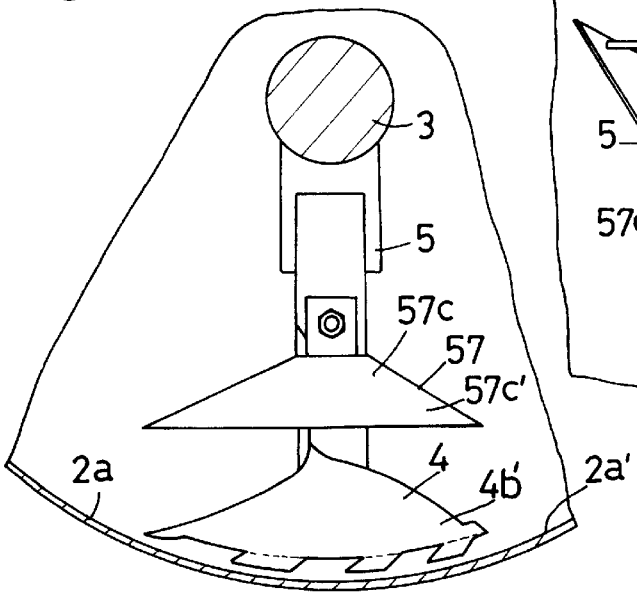

MIXING DEVICE

This application is the national phase under 35 U.S.C. § 371 of PCT International Application No. PCT/JP98/01831 which has an International filing date of Apr. 22, 1998, which designated the United States of America.

TECHNICAL FIELD

The present invention is related to a mixing method and mixing apparatus, which ejects a gas for conditioning the physical properties of a material being mixed, such as the moisture content and temperature thereof. The mixing is conducted by stirring material having fluidity, such as fine particles and a granular material.

BACKGROUND ART

Japanese Examined Utility Model Publication HEI No. 5-36493 discloses a mixing apparatus, comprising a vessel of a material to be mixed; a rotating shaft provided to be drivable in a rotating manner around a horizontal axis inside this vessel; a stirring member provided so as to rotate together with the rotating shaft; an air jet provided on the stirring member; and a pulverizing member provided to be drivable in a rotating manner on the inner circumference of the vessel opposite the outer circumference of the rotating shaft. Air is ejected from the jet rearwardly of the direction of rotation of the stirring member to prevent the material being mixed from adhering to the inner circumference of the vessel.

However, with this prior art mixing apparatus, granulation and various chemical reactions cannot be properly performed by adding water and a reactive solution to the material to be mixed. For example, when performing granulation by adding water to the material to be mixed, it is believed that dry air ejected from the jet dries the material being mixed. However, with this prior art mixing apparatus, the dry air is ejected rearwardly of the direction of rotation of the stirring member. Since a space in the rear of the direction of rotation of the stirring member is created by forcing aside the material being mixed with the stirring member, the dry air and material being mixed cannot make contact in an efficient manner. Further, even if cooling air is ejected from the jet during an exothermic reaction caused by adding a reactive solution to the material being mixed, the cooling air and the material being mixed cannot make contact in an efficient manner. That is, because the air and the material being mixed cannot make efficient contact, the moisture content and temperature of the material being mixed cannot be efficiently conditioned.

Japanese Patent Laid-open SHO No. 51-61621 discloses a mixing apparatus, comprising a vessel of a material to be mixed; a rotating shaft provided to be drivable in a rotating manner around a vertical axis inside the vessel; a stirring member provided so as to rotate together with the rotating shaft; a jet, which ejects air upwardly from the center of the rotating shaft; another jet, which ejects air so that the air flows forwardly of the direction of rotation of the stirring member in a space above the material being mixed; and means for supplying a liquid to the inside portion of the vessel. Rotating the stirring member generates a vortex of air, which is ejected upwardly from the center of the stirring member. This swirling motion is enhanced by air, which is introduced so as to flow forwardly of the direction of rotation of the stirring member in the space above the material being mixed.

However, since the air flows in the space above the material being mixed, it only comes in contact with the surface of the material being mixed. That is, because the air and the material being mixed cannot make efficient contact, the moisture content and temperature of the material being mixed cannot be efficiently conditioned.

Great Britain Patent No. 1369269 discloses a mixing apparatus, comprising a vessel of a material to be mixed; a rotating shaft provided to be drivable in a rotating manner around an axis inside this vessel; a stirring member provided so as to rotate together with the rotating shaft; means for ejecting a gas for conditioning the physical properties of the material being mixed inside the vessel; a pulverizing member provided to be drivable in a rotating manner on the inner circumference of the vessel facing the outer circumference of the rotating shaft; and means for supplying a liquid to the inside of the vessel. A gas jet is provided at a fixed location relative to the vessel so as to enable the ejection of a gas from within the material being mixed during mixing.

However, with this prior art, nothing is disclosed concerning the direction in which a gas is ejected. That is, since no consideration is given to the air and the material being mixed making efficient contact, the moisture content and temperature of the material being mixed cannot be efficiently conditioned.

The object of the present invention is to provide a mixing method and mixing apparatus capable of solving the above-mentioned problems.

DISCLOSURE OF THE INVENTION

The mixing method of the present invention is characterized in that, when stirring a material being mixed with a stirring member, which rotates around an axis inside a vessel, a gas for conditioning the physical properties of the material being mixed is ejected forwardly of the direction of rotation of the stirring member from within the material being mixed during mixing.

The mixing apparatus of the present invention comprises a vessel for containing a material to be mixed; the rotating shaft provided to be drivable in a rotating manner around an axis inside the vessel; a stirring member provided so as to rotate together with the rotating shaft; and means for ejecting a gas for conditioning the physical properties of the material being mixed inside the vessel. A gas jet is provided in a fixed location relative to the vessel so as to enable the gas to be ejected from within the material being mixed during mixing. The gas is ejected forwardly of the direction of rotation of the stirring member.

According to the method of the present invention, a gas is ejected forwardly of the direction of rotation of the stirring member from within the material being mixed, during mixing, so that the residence time of the gas inside the material being mixed is lengthened, and thus the physical properties of the material being mixed is conditioned efficiently by the gas. The method of the present invention can be implemented with the apparatus of the present invention.

In the apparatus of the present invention, it is preferable that the rotating shaft is driven in a rotating manner around a horizontal axis; that the inner circumference of the vessel has a curved surface, which parallels a rotating body which is coaxial with the rotating shaft; and that the gas jet is arranged so that the ejected gas flows upwardly along the inner circumference of the vessel from the lower portion of the vessel.

According to this construction, even if the volume of the material to be mixed and stored in the vessel is much less than the capacity of the vessel, the residence time of the gas inside the material being mixed can be effectively lengthened, and the contact efficiency of the gas and the material being mixed can be enhanced.

It is preferable that the gas jet is constituted of an opening at the end of a pipe inserted into the vessel; that the end of the pipe is inclined relative to the horizontal plane so as to go rearwardly of the direction of rotation of the stirring member and in the downward direction; and the angle formed by the end of the pipe and horizontal plane of the pipe is less than the angle of repose of the powdered material to be mixed.

According to this construction, the material being mixed can be prevented from entering inside of the pipe.

It is preferable that a pulverizing member is provided to be drivable in a rotating manner on the inner circumference of the vessel facing the outer circumference of the rotating shaft, and that the location of the pulverizing member in the axial direction of the above-mentioned rotating shaft corresponds to the location of the gas jet in the axial direction of the above-mentioned rotating shaft.

According to this constitution, since the material being mixed can be made to flow toward the pulverizing member by the gas, the material being mixed can be pulverized more efficiently.

It is preferable that means for supplying a liquid to the inside of the vessel and a dispersing member which disperses the liquid supplied are provided, and that the location of the dispersing member in the axial direction of the above-mentioned rotating shaft correspond to the location of the above-mentioned gas jet in the axial direction of the above-mentioned rotating shaft.

According to this construction, causing the gas to flow to the location at which the liquid is supplied in a concentrated manner makes it possible to enhance the contact efficiency of the gas and the material being mixed in this liquid supply location. Therefore, the physical properties of the material being mixed can be efficiently conditioned, that is, dried and cooled, by the gas.

According to the present invention, it is possible to provide a mixing method and mixing apparatus, which are capable of efficiently conditioning the moisture content, temperature and other physical properties of a material being mixed by a gas.

BRIEF DESCRIPTION OF THE DRAWINGS

The present invention will become more fully understood from the detailed description given hereinbelow and the accompanying drawings which are given by way of illustration only, and thus do not limit the present invention.

FIG. 9 (1) is a partial plan view of a horizontal-type mixing apparatus of a third embodiment of the present invention, FIG. 9 (2) is a partial front view of the horizontal-type mixing apparatus of the third embodiment of the present invention, and FIG. 9 (3) is a partial side view of the horizontal-type mixing apparatus of the third variation of the present invention;

FIG. 10 (1) is a partial front view of a horizontal-type mixing apparatus of a fourth embodiment of the present invention, FIG. 10 (2) is a partial side view of the horizontal-type mixing apparatus of the fourth embodiment of the present invention, FIG. 10 (3) is a partial plan view of the horizontal-type mixing apparatus of the fourth embodiment of the present invention, and FIG. 10 (4) is a partial bottom view of the horizontal-type mixing apparatus of the fourth embodiment of the present invention;

BEST MODE FOR CARRYING OUT THE INVENTION

The embodiments of the present invention are described hereinbelow with reference to the figures.

Figure 1:
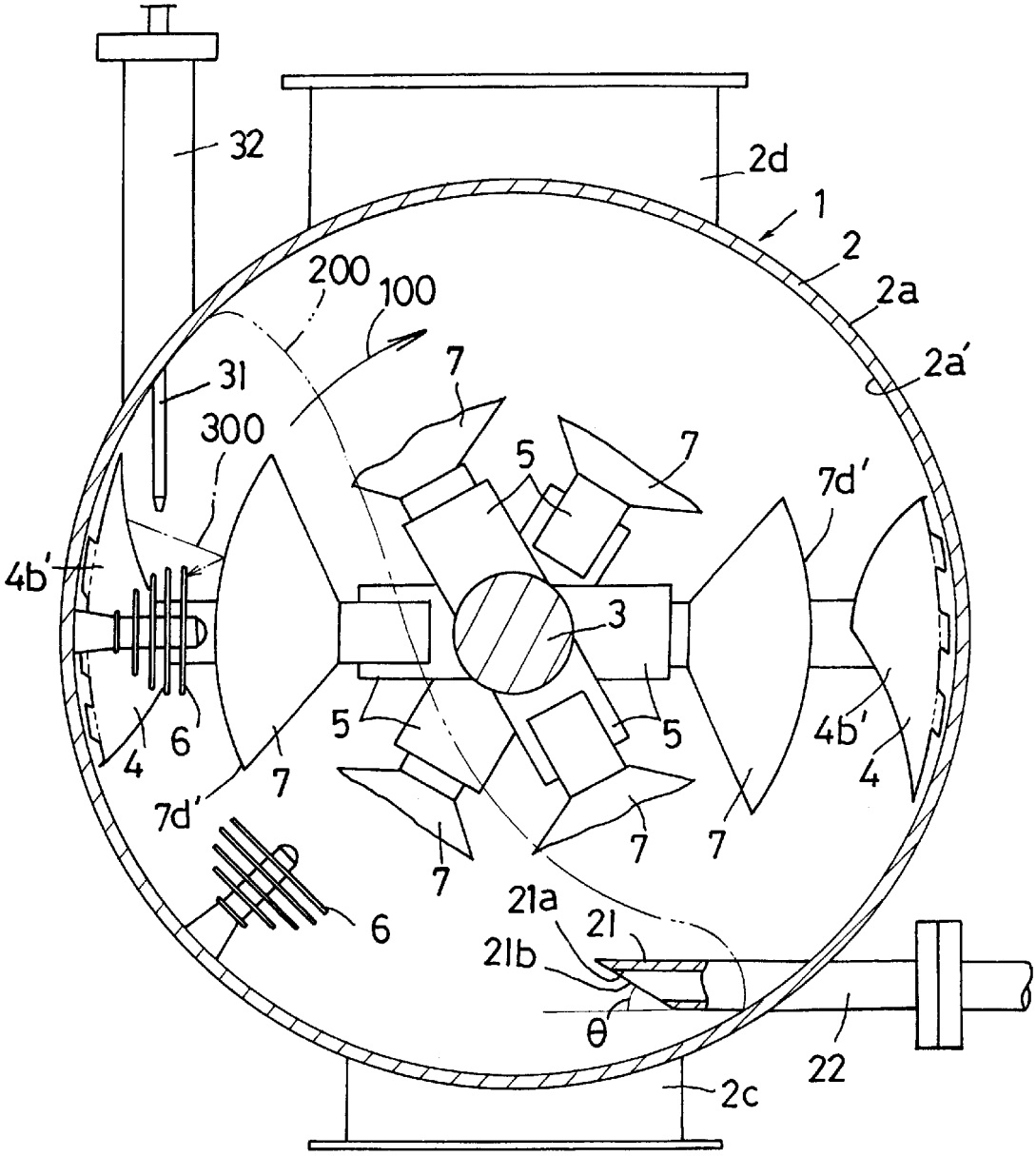
FIG. 1 is a side cross-sectional view of a horizontal-type mixing apparatus of the present invention.
Figure 2:
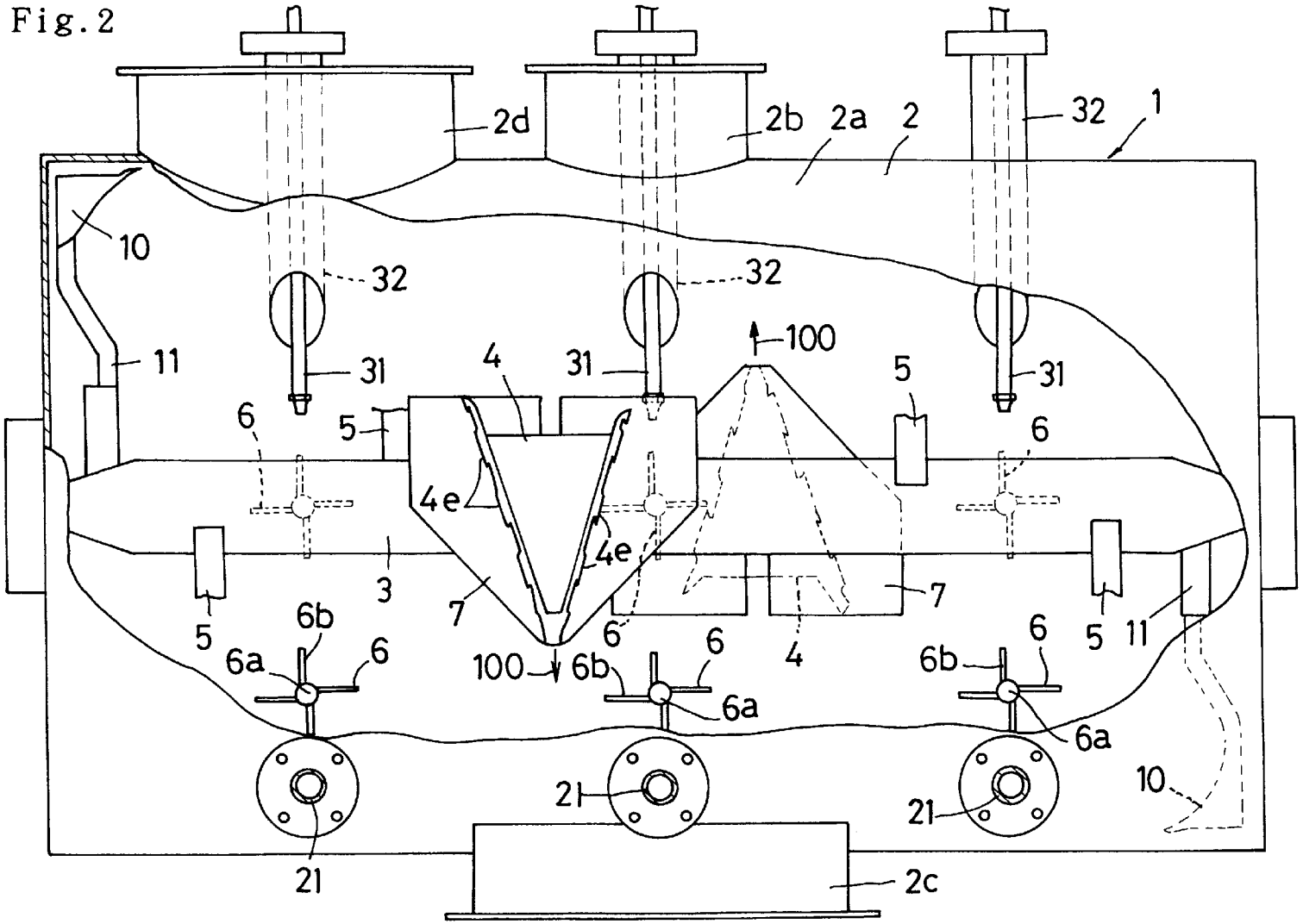
FIG. 2 is a partial front breakdown view of the horizontal-type mixing apparatus of the present invention.

The horizontal-type mixing apparatus 1 shown in FIG. 1 and FIG. 2 comprises a vessel 2 for containing a material being mixed. This vessel 2 has a cylindrical-type vessel main body 2*a* having a horizontal central axis, an inlet portion 2*b* for the material to be mixed, a mixture discharge portion 2*c*, and an exhaust gas portion 2*d*.

Inside the vessel 2, a rotating shaft 3, which is capable of rotating around a horizontal axis with the same center as the axis of the vessel main body 2*a*, is supported at both ends. This rotating shaft 3 is driven in a rotating manner in the direction of arrow 100 in FIG. 1 by a driving source, such as a motor (omitted from the figure).

Six stirring members 4 are provided so as to rotate together with the rotating shaft 3 in the direction of arrow 100. In this embodiment, the stirring members 4 are arranged, for example, every 60 degrees in the direction of rotation at six mutually separate locations in the axial direction of the rotating shaft 3. In the figure, only two stirring members 4 of the center of the rotating shaft 3 are displayed; diagrams of the four stirring members 4 on the ends of the rotating shaft 3 have been omitted. The two stirring members 4 near the center of the rotating shaft 3 are arranged, for example, 180 degrees apart in the direction of rotation. The two stirring members near to one end of the rotating shaft 3 are arranged, for example, 180 degrees apart in the direction of rotation. The two stirring members near to the other end of the rotating shaft 3 are arranged, for example, 180 degrees apart in the direction of rotation. Each stirring member 4 is mounted to an arm 5, which protrudes from this rotating shaft 3. The number of stirring members 4 is not particularly limited.

Figure 3:
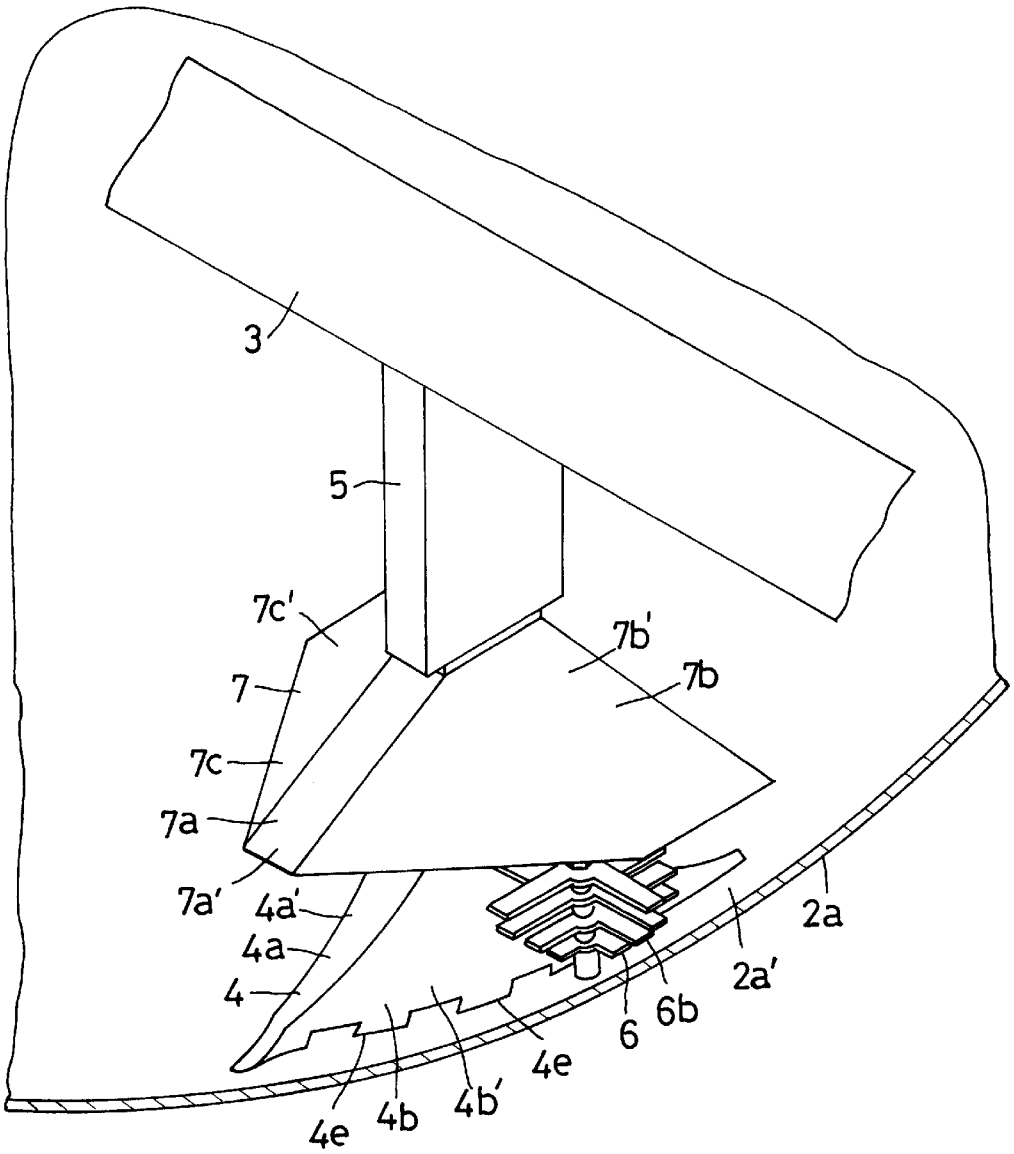
FIG. 3 is a perspective view of the principal portions of the horizontal-type mixing apparatus of the present invention.
Figure 4:
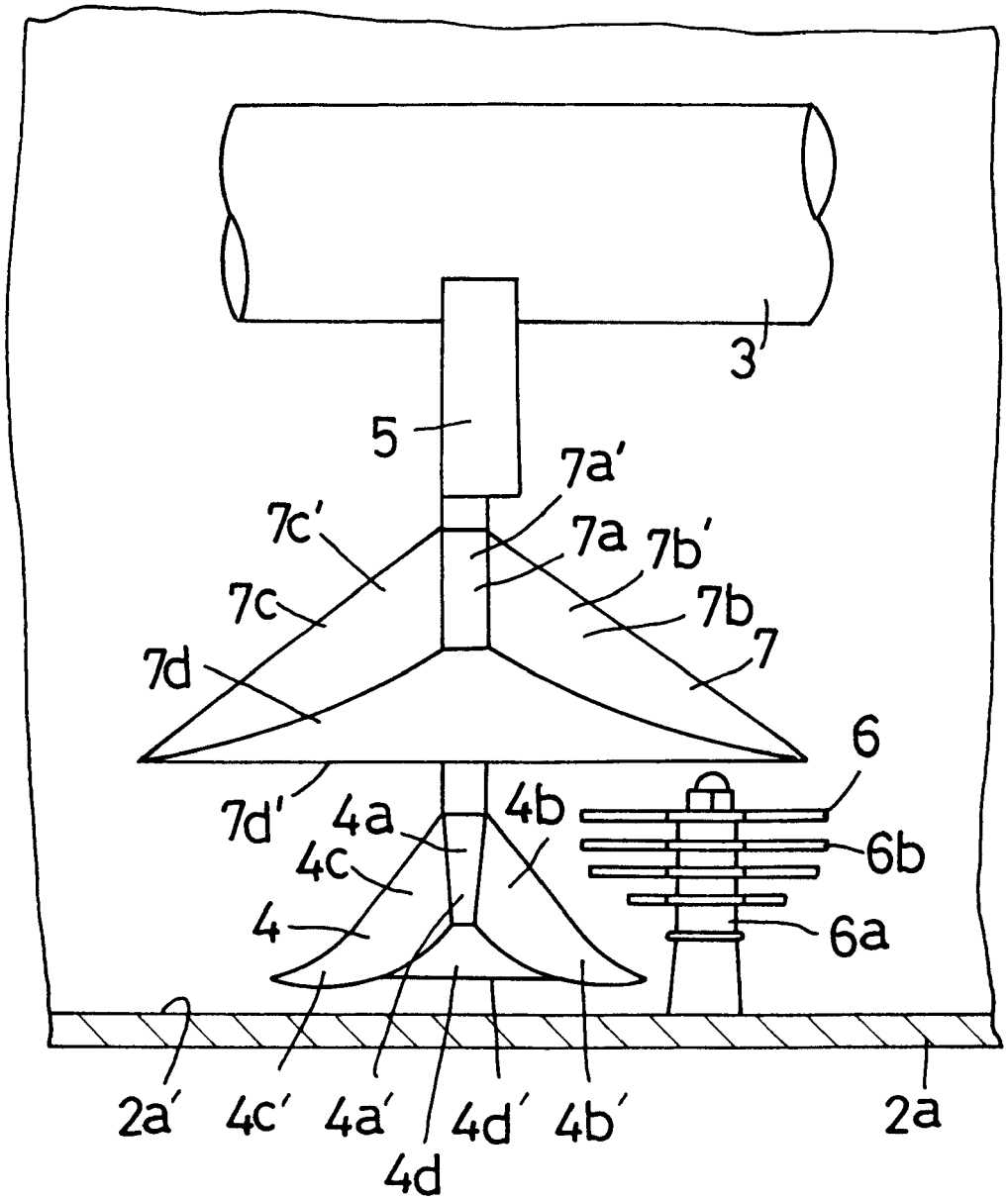
FIG. 4 is a front view of the principal portions of the horizontal-type mixing apparatus of the present invention.
Figure 5:
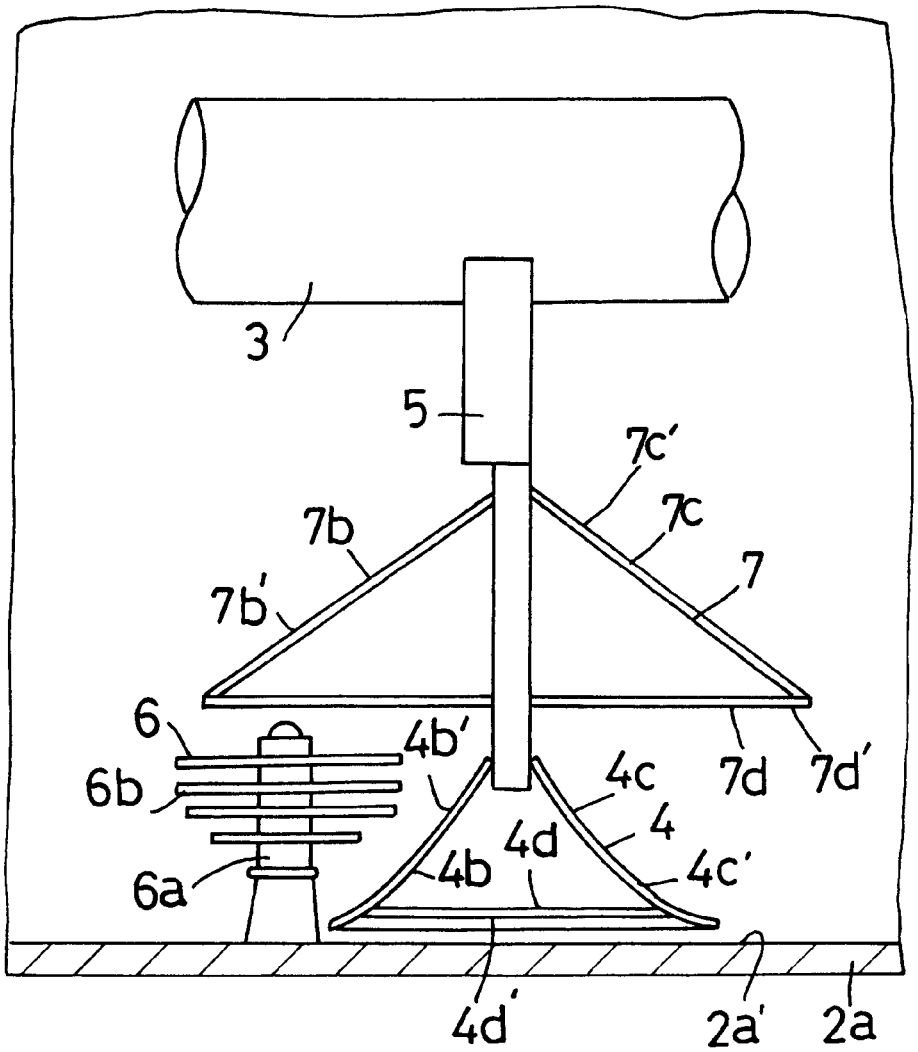
FIG. 5 is a rear view of the principal portions of the horizontal-type mixing apparatus of the present invention.
Figure 6:
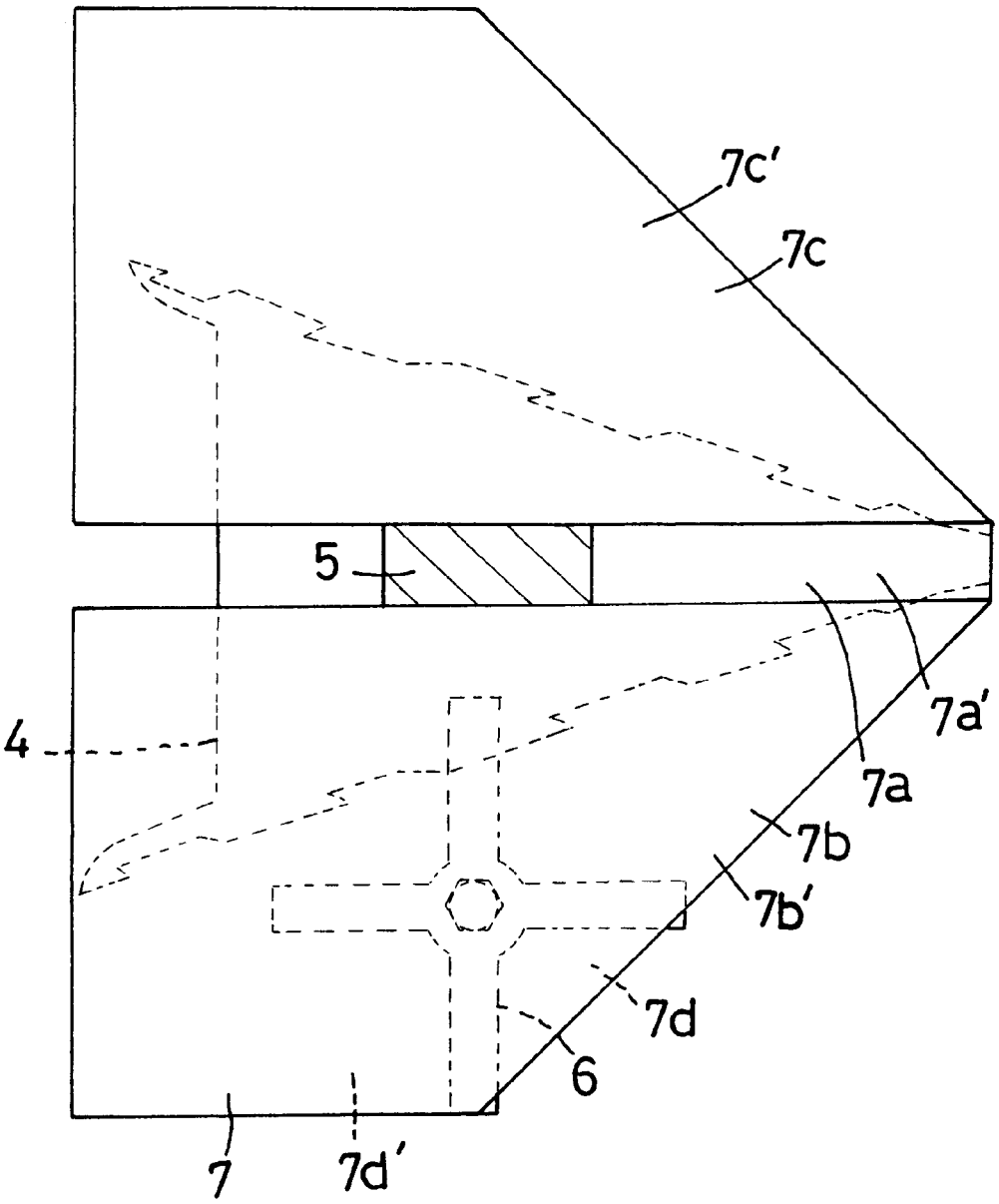
FIG. 6 is a plan view of the principal portions of the horizontal-type mixing apparatus of the present invention.

As shown in FIG. 3 through FIG. 5, each stirring member 4 has a plate-shaped front wall 4*a* located forwardly of the arm 5 in the direction of rotation thereof, a pair of plate-shaped side walls 4*b*, 4*c* located to the sides of the arm 5 in the axial direction of the rotating shaft 3, and a plate-shaped bottom wall 4*d* located outwardly of the side walls 4*b*, 4*c* in the radial direction of the rotating shaft 3.

The surface 4*a*' of the front wall 4*a* is arranged by leaving a space relative to the outer circumference of the rotating shaft 3 in the radial direction of rotation. The radial direction of rotation signifies the radial direction of the rotating shaft 3. The distance between the surface 4*a*' of the front wall 4*a* and the outer circumference of the rotating shaft 3 gradually increases forwardly of the direction of rotation.

The surface 4*b*' of one of the side walls 4*b* is arranged by leaving a space relative to the outer circumference of the rotating shaft 3 in the radial direction of rotation. The distance between the surface 4*b*' of this side wall 4*b* and the outer circumference of the rotating shaft 3 gradually increases forwardly of the direction of rotation, and also gradually increases on the way toward one end of the rotating shaft 3.

The surface 4*c*' of the other side wall 4*c* is arranged by leaving a space relative to the outer circumference of the rotating shaft 3 in the radial direction of rotation. The distance between the surface 4*c*' of this side wall 4*c* and the outer circumference of the rotating shaft 3 gradually increases forwardly of the direction of rotation, and also gradually increases on the way toward the other end of the rotating shaft 3.

The dimensions of each side wall 4*b*, 4*c* in the radial direction and axial direction of the rotating shaft 3 gradually increase rearwardly of the direction of rotation.

The surface 4*a*' of this front wall 4*a*, and the surfaces 4*b*', 4*c*' of each side wall 4*b*, 4*c* constitute the stirring surface, which causes a material being mixed to flow toward the outer circumference of the rotating shaft 3 in accordance with the rotation of the rotating shaft 3.

As shown in FIG. 2, FIG. 3, a plurality of teeth 4*e* are formed on the outer edge of each side wall 4*b*, 4*c* to reduce load during rotation. The teeth 4*e* can also be omitted.

The surface 4*d*' of the bottom wall 4*d* is arranged by leaving a space relative to the inner circumference 2*a*' of the vessel main body 2*a* in the radial direction of rotation, the inner circumference 2*a*' of the vessel main body 2*a* and the surface 4*d*' of the bottom wall 4*d* constitute curved surfaces, which parallel a rotating body which is coaxial with the rotating shaft 3, so that the space in the radial direction of rotation becomes constant. The rotating body is a circular cylinder in this embodiment, but so long as it is a rotating body, there are no limitations in particular.

Six pulverizing members 6 are provided on the inner circumference 2*a*' of the vessel main body 2*a*. Each pulverizing member 6 has a rotating shaft 6*a* capable of rotating around an axis, which parallels the radial direction of the vessel main body 2*a*, and a plurality of pulverizing blades 6*b*, which extend outwardly in the radial direction of rotation of the shaft 6*a* from this rotating shaft 6*a*, and is driven in a rotating manner by a driving source (omitted from the figure) such as a motor. Here, the radial direction of rotation signifies the radial direction of the rotating shaft 6*a*.

As shown in FIG. 2, in this embodiment, the pulverizing members 6 number in six, and are arranged by two in three separate locations in the axial direction of rotating shaft 3. The two pulverizing members 6 in each of the three separate locations in the axial direction of rotating shaft 3 are arranged apart from one another in the direction of rotation of rotating shaft 3.

That is, the rotating shafts of the two pulverizing members 6 arranged to the center in the axial direction of rotating shaft 3 are positioned closer to one end of rotating shaft 3 than to one of the stirring surfaces 4*b*' of one of the two stirring members 4 near to the center of rotating shaft 3, and are positioned closer to the other end of rotating shaft 3 than to another of the stirring surfaces 4*c*' of the other of the two stirring members 4 near to the center of rotating shaft 3.

The rotating shafts of the two pulverizing members 6 arranged near to the one end of rotating shaft 3 are positioned closer to one end of rotating shaft 3 than to one of the stirring surfaces 4*b*' of one of the two stirring members 4 near to one end of rotating shaft 3, and are positioned closer to the other end of rotating shaft 3 than to another of the stirring surfaces 4*c*' of the other of the two stirring members 4 near to one end of rotating shaft 3.

The rotating shafts of the two pulverizing members 6 arranged near to the other end of rotating shaft 3 are positioned closer to one end of rotating shaft 3 than to one of the stirring surfaces 4*b*' of one of the two stirring members 4 near to the other end of rotating shaft 3, and are positioned closer to the other end of rotating shaft 3 than to another of the stirring surfaces 4*c*' of the other of the two stirring members 4 near to the other end of rotating shaft 3.

The configuration height of three pulverizing members 6 is set at roughly ½ the height of the vessel main body 2*a*. The configuration height of the other three pulverizing members 6 is set so as to be arranged between the bottom portion and ½ the height of the vessel main body 2*a*. The number of pulverizing members 6 is not limited in particular.

Six flow direction-changing members 7 are provided so as to rotate together with the rotating shaft 3. In this embodiment, each flow direction-changing member 7 faces, in a one-to-one manner, each of the above-mentioned stirring members 4. That is, each flow direction-changing member 7 is mounted to an above-mentioned arm 5 so as to be arranged between each stirring member 4 and the rotating shaft 3. The number of flow direction-changing members 7 is not particularly limited.

As shown in FIG. 3 through FIG. 6, each flow direction-changing member 7 has a plate-shaped front wall 7*a* located forwardly of the arm 5 in the direction of rotation thereof, a pair of plate-shaped side walls 7*b*, 7*c* located to the sides of the arm 5 in the axial direction of the rotating shaft 3, and a plate-shaped bottom wall 7*d* located outwardly of the side walls 7*b*, 7*c* in the radial direction of rotation of the rotating shaft 3.

The surface 7*a*' of the front wall 7*a* is arranged by leaving a space relative to the outer circumference of the rotating shaft 3 in the radial direction of rotation, and this space in the radial direction of rotation gradually increases forwardly of the direction of rotation.

The surface 7*b*' of one of the side walls 7*b* is arranged by leaving a space relative to the outer circumference of the rotating shaft 3 in the radial direction of rotation, and this space in the radial direction of rotation gradually increases forwardly of the direction of rotation and gradually increases on the way toward one end of the rotating shaft 3.

The surface 7*c*' of the other side wall 7*c* is arranged by leaving a space relative to the outer circumference of the rotating shaft 3 in the radial direction of rotation, and this space in the radial direction of rotation gradually increases forwardly of the direction of rotation and gradually increases on the way toward the other end of the rotating shaft 3.

The surface 7*a*' of the front wall 7*a*, and the surfaces 7*b*', 7*c*' of each side wall 7*b*, 7*c* constitute an auxiliary stirring surface, which causes the material being mixed to flow toward the outer circumference of the rotating shaft 3 in accordance with the rotation of the rotating shaft 3.

The dimensions of each side wall 7*b*, 7*c* in the radial direction and axial direction of the rotating shaft 3 gradually increase rearwardly of the direction of rotation, becoming constant thereafter.

The surface of the bottom wall 7*d* is arranged by leaving a space relative to the inner circumference 2*a*' of the vessel main body 2*a* in the radial direction of rotation between the above-mentioned stirring surface 4*a*', 4*b*', 4*c*' and the outer circumference of the rotating shaft 3, and constitutes a changing surface 7*d*', which changes the direction of flow of the material being mixed from a direction toward the outer circumference of the rotating shaft 3 to a direction toward the inner circumference 2*a*' of the vessel main body 2*a*.

The inner circumference 2*a*' of the vessel main body 2*a* and the changing surface 7*d*' constitute curved surfaces, which parallel a rotating body which is coaxial with the rotating shaft 3, so that the space in the radial direction of rotation between the inner circumference 2*a*' of the vessel main body 2*a* and the changing surface 7*d*' becomes constant. The rotating body is a circular cylinder in this embodiment, but is not particularly limited to this shape.

The changing surface 7*d*' has a portion, which faces the above-mentioned stirring surface 4*a*', 4*b*', 4*c*' across a space in the radial direction of rotation. In this embodiment, the dimensions of the changing surface 7*d*' in the direction of rotation are roughly equivalent to the dimensions of the stirring member 4 in the direction of rotation. The dimensions of the changing surface 7*d*' in the axial direction of the rotating shaft 3 are larger than the dimensions of the stirring member 4 in the axial direction of the rotating shaft 3. In accordance therewith, the changing surface 7*d*' covers the entire stirring surface 4*a*', 4*b*', 4*c*' in the radial direction of rotation.

It is desirable that the maximum dimensions in the direction of rotation of the changing surface 7*d*' is equivalent to, or larger than, the maximum dimensions in the direction of rotation of the stirring member 4 so as to enable coverage of the entire stirring surface 4*a*', 4*b*', 4*c*'. It is desirable that the front end position of the changing surface 7*d*' in the direction of rotation either correspond to the stirring member 4, or is arranged further rearwardly of the direction of rotation than the front end position of the stirring member 4 in the direction of rotation. It is desirable that the rear end position of the changing surface 7*d*' in the direction of rotation either correspond to the stirring member 4, or is arranged further rearwardly of the direction of rotation than the rear end position of the stirring member 4 in the direction of rotation.

The changing surface 7*d*' has a portion, which faces the above-mentioned pulverizing member 6 entirely in the radial direction of rotation partway through a rotation. That is, the changing surfaces 7*d*' of two flow direction-changing members 7 near to the center of the rotating shaft 3 face two pulverizing members 6 positioned to the center of the rotating shaft 3 in the radial direction of rotation partway through a rotation. The changing surfaces 7*d*' of two flow direction-changing members 7 near to one end of the rotating shaft 3 face two pulverizing members 6 positioned near to the one end of the rotating shaft 3 in the radial direction of rotation partway through a rotation. The changing surfaces 7*d*' of two flow direction-changing members 7 near to the other end of the rotating shaft 3 face two pulverizing members 6 positioned near to the other end of the rotating shaft 3 in the radial direction of rotation partway through a rotation.

As shown in FIG. 2, two auxiliary stirring members 10 are arranged at two locations close to either end of the rotating shaft so as to rotate together with the rotating shaft 3. These two auxiliary stirring members 10 are arranged, for example, 180 degrees apart to each other in the direction of rotation. Each auxiliary stirring member 10 is mounted to an arm 11, which protrudes from the rotating shaft 3, and are provided close to the outer circumference of the vessel main body 2*a*. The shape of each auxiliary stirring member 10 is not particularly limited so long as the material being mixed can be stirred. Further, a plurality of auxiliary stirring members 10 can be provided at the same location.

As shown in FIG. 1, FIG. 2, three pipes 21 are provided inside the vessel main body 2*a* for ejecting a gas, which is utilized to condition the moisture content, temperature, composition, and other physical properties of the material being mixed. For example, dry air or inert gas is ejected to condition the moisture content of the material being mixed; temperature-controlled air or inert gas is ejected to condition the temperature of the material being mixed; and a reactive gas is ejected to condition the composition of a material being mixed via a reaction.

In this embodiment, these gas supply pipes 21 are provided in three locations spaced along the axial direction of the rotating shaft 3. That is, each pipe 21 is provided in a fixed location relative to the vessel main body 2*a* by being inserted inside the vessel main body 2*a*, and secured using welding or some other well-known securing method. A gas jet 21*a*, which is constituted of the opening at the end of each pipe 21, is arranged at a fixed location relative to the vessel main body 2*a* so as to eject a gas from within the material being mixed during mixing. The volume of the material being mixed stored in the vessel main body 2*a* is set at less than the capacity of the vessel main body 2*a*. The two-dot chain line 200 in FIG. 1 shows one example of the surface position of a material being mixed during the mixing thereof. The number of gas jets 21*a* is not particularly limited.

The gas from each gas jet 21*a* is ejected forwardly of the direction of rotation of the above-mentioned stirring member 4. Furthermore, each gas jet 21*a* is arranged close to the bottom portion of the vessel main body 2*a* so that the ejected gas flows upwardly from the lower portion of the vessel main body 2*a* along the inner circumference 2*a*' of the vessel main body 2*a*.

The end 21*b* of each pipe 21 is inclined relative to the horizontal plane so as to go rearwardly of the direction of rotation of a stirring member 4 with going downward. The angle θ formed by the end 21*b* of the pipe 21 and the horizontal plane is set at less than the angle of repose of the powdered material being mixed.

The location of each gas jet 21*a* in the axial direction of the rotating shaft 3 corresponds to the location of each of the above-mentioned pulverizing members 6 in the axial direction of the rotating shaft 3. That is, relative to a gas jet 21*a* arranged to the center of the rotating shaft 3, two pulverizing members 6 arranged to the center of the rotating shaft 3 are positioned forwardly of the direction of rotation of the stirring member 4 in the material being mixed during stirring. Relative to a gas jet 21*a* arranged near to one end of the rotating shaft 3, two pulverizing members 6 arranged near to one end of the rotating shaft 3 are positioned forwardly of the direction of rotation of the stirring member 4 in the material being mixed during stirring. Relative to a gas jet 21*a* arranged near to the other end of the rotating shaft 3, two pulverizing members 6 arranged near to the other end of the rotating shaft 3 are positioned forwardly of the direction of rotation of the stirring member 4 in the material being mixed during stirring.

Three pipes 31 are provided for supplying a liquid to the inside of the vessel main body 2*a*. As this liquid, there is supplied, for example, a granulating liquid for granulating the powdered material being mixed, and a reactive liquid, which generates a chemical reaction when brought in contact with the material being mixed.

In this embodiment, these liquid supply pipes 31 are provided in three locations spaced along the axial direction of the rotating shaft 3. That is, each pipe 31 is arranged in a fixed location relative to the vessel main body 2*a* by being inserted inside the vessel main body 2*a* via a cylindrical guide body 32 mounted to the vessel main body 2*a*, and secured to this guide body 32. In this embodiment, a liquid discharge opening, which is constituted of the opening at the end of each pipe 31, is arranged at a fixed location relative to the vessel main body 2*a* so as to be able to downwardly discharge a liquid from within the material being mixed during mixing. A liquid downwardly discharged from each liquid supply pipe 31 moves rearwardly of the direction of rotation of the above-mentioned stirring member 4 in this embodiment. A plurality of pipes 31 can be provided at the same location.

The locations of the liquid discharge openings of these liquid supply pipes 31 in the axial direction of the rotating shaft 3 correspond to the locations of the above-mentioned pulverizing members 6 in the axial direction of the rotating shaft 3. That is, a pulverizing member 6 located to the center of the rotating shaft 3 at roughly ½ the height of the vessel main body 2*a* is opposite to a liquid discharge opening located to the center of the rotating shaft 3. A pulverizing member 6 located near to one end of the rotating shaft 3 at roughly ½ the height of the vessel main body 2*a* is opposite to a liquid discharge opening located near to one end of the rotating shaft 3. A pulverizing member 6 located near to the other end of the rotating shaft 3 at roughly ½ the height of the vessel main body 2*a* is opposite to a liquid discharge opening located to the other end of the rotating shaft 3. In accordance therewith, each pulverizing member 6 located at roughly ½ the height of the vessel main body 2*a* also serves as a dispersing member, which disperses a liquid supplied from each pipe 31. The locations of the dispersing members 6 in the axial direction of the rotating shaft 3 correspond to the locations of the above-mentioned gas jets 21*a* in the axial direction of the rotating shaft 3.

According to the above mixing apparatus, the mixing of the material to be mixed is performed by stirring with the stirring member 4. Further, the aggregated mixture is pulverized in accordance with the rotation of the pulverizing member 6. The material being mixed is made to flow toward the outer circumference of the rotating shaft 3 by the stirring surface 4*a*', 4*b*', 4*c*' of the stirring member 4 thereof. The one-dot chain line 300 in FIG. 1 shows the direction of flow of the material being mixed. The direction of flow of the material being mixed is made to change from a direction toward the outer circumference of the rotating shaft 3 to a direction toward the inner circumference 2*a*' of the vessel main body 2*a* by the changing surface 7*d*' of the flow direction-changing member 7. Accordingly, the material being mixed can be prevented from flowing in a direction away from the pulverizing member 6 located on the inner circumference 2*a*' of the vessel main body 2*a*. In accordance therewith, opportunities for contact between the material being mixed and the pulverizing member 6 can be increased, and the material being mixed can be pulverized more efficiently.

Further, by one stirring surface 4*b*' of each stirring member 4, the material being mixed can be made to flow so as to move toward one end of the rotating shaft 3 in accordance with moving toward the outer circumference of the rotating shaft 3. Accordingly, by the changing surface 7*d*' which faces the stirring surface 4*b*', the direction of flow of the material being mixed can be changed to a direction toward the inner circumference 2*a*' of the vessel main body 2*a*, and to a direction toward one end of the rotating shaft 3. In accordance therewith, opportunities for contact between the material being mixed and the pulverizing member 6 can be increased at a location closer to one end of the rotating shaft 3 than to the stirring surface 4*b*', and the material being mixed can be pulverized more efficiently by the pulverizing member 6.

Since each changing surface 7*d*' has a portion, which faces the pulverizing member 6 in the radial direction of rotation partway through a rotation, it is possible to increase opportunities for contact between the material being mixed and the pulverizing member 6, and to enhance pulverizing efficiency.

Since the inner circumference 2*a*' of the vessel main body 2*a*, and the changing surface 7*d*' are constituted as curved surfaces, which parallel a rotating body which is coaxial with the rotating shaft 3, the distance between the inner circumference 2*a*' of the vessel main body 2*a* and the changing surface 7*d*' becomes constant. In accordance therewith, the direction of flow of the material being mixed introduced between the inner circumference 2*a*' and changing surface 7*d*' can be smoothly changed by the changing surface 7*d*', making it possible to increase opportunities for contact between the material being mixed and the pulverizing member, and to enhance pulverizing efficiency.

Since the changing surface 7*d*' has a portion, the dimensions in the axial direction of the rotating shaft 3 of which are gradually increased rearwardly of the direction of rotation, the changing surface 7*d*' can make efficient contact with a material being mixed which is flowing toward one end of the rotating shaft 3 in accordance with flowing toward the outer circumference of the rotating shaft 3, making it possible to change the direction of flow of the material being mixed.

According to the above constitution, it is possible to enhance stirring efficiency by making the material being mixed flow toward the outer circumference of the rotating shaft 3 by auxiliary stirring surface 7*a*', 7*b*', 7*c*'. Since the auxiliary stirring surfaces 7*a*', 7*b*', 7*c*' are provided on the flow direction-changing member 7, and are arranged by leaving a space relative to the outer circumference of the rotating shaft 3 in the radial direction of rotation, the auxiliary stirring surface 7*a*', 7*b*', 7*c*' does not impede the changing surface 7*d*' from changing the direction of flow of a material being mixed. The space in the radial direction of rotation between the auxiliary stirring surface 7*a*', 7*b*', 7*c*' and the outer circumference of the rotating shaft 3 gradually increases forwardly of the direction of rotation, and also gradually increases on the way toward one end of the rotating shaft 3.

Since the above-mentioned gas jet 21*a* ejects a gas forwardly of the direction of rotation of the stirring member 4 from within the material being mixed during mixing, the residence time of the gas inside the material being mixed can be lengthened, making it possible to efficiently condition the properties of the material being mixed, i.e. to dry or cool the material being mixed with the gas. The gas jet 21*a* is arranged so that the ejected gas flows upwardly along the inner circumference of the vessel from the lower portion of the vessel main body 2*a*. In accordance therewith, even if the volume of the material being mixed stored in the vessel main body 2*a* is much less than the capacity of the vessel main body 2*a*, the residence time of the gas inside the material being mixed can be lengthened as long as possible, making it possible to enhance the contact efficiency between the gas and the material being mixed. Since the angle θ formed between the end 21*b* of the pipe 21, which constitutes the gas jet 21*a*, and the horizontal plane is less than the angle of repose of the powdered material to be mixed, it is possible to prevent the material being mixed from entering inside the pipe 21. The location of each gas jet 21*a* in the axial direction of the rotating shaft 3 corresponds to the location of each of the above-mentioned pulverizing members 6 in the axial direction of the rotating shaft 3. No stirring member 4 passes through the circumferential area of the vessel main body 2*a*, where the pulverizing member 6 is located, so as not to interfere with the pulverizing member 6. Consequently, the location of each gas jet 21*a* in the axial direction of the rotating shaft 3 corresponds to the location of each of the above-mentioned pulverizing members 6 in the axial direction of the rotating shaft 3, and the material being mixed is prevented from residing in an area, where no stirring member 4 passes through, by the gas ejected from each gas jet 21*a*; and the material being mixed flows toward the pulverizing member 6, pulverizing the material being mixed more efficiently. Furthermore, causing a gas to flow to a location, in which a liquid from the liquid supply pipe 31 is supplied in a concentrated manner, can enhance the contact efficiency between the gas and the material being mixed in the liquid supply location. In accordance therewith, it is possible to efficiently condition the properties of the material being mixed, i.e. to dry or to cool the material being mixed with the gas.

The present invention is not limited to the above embodiment.

Figure 7:
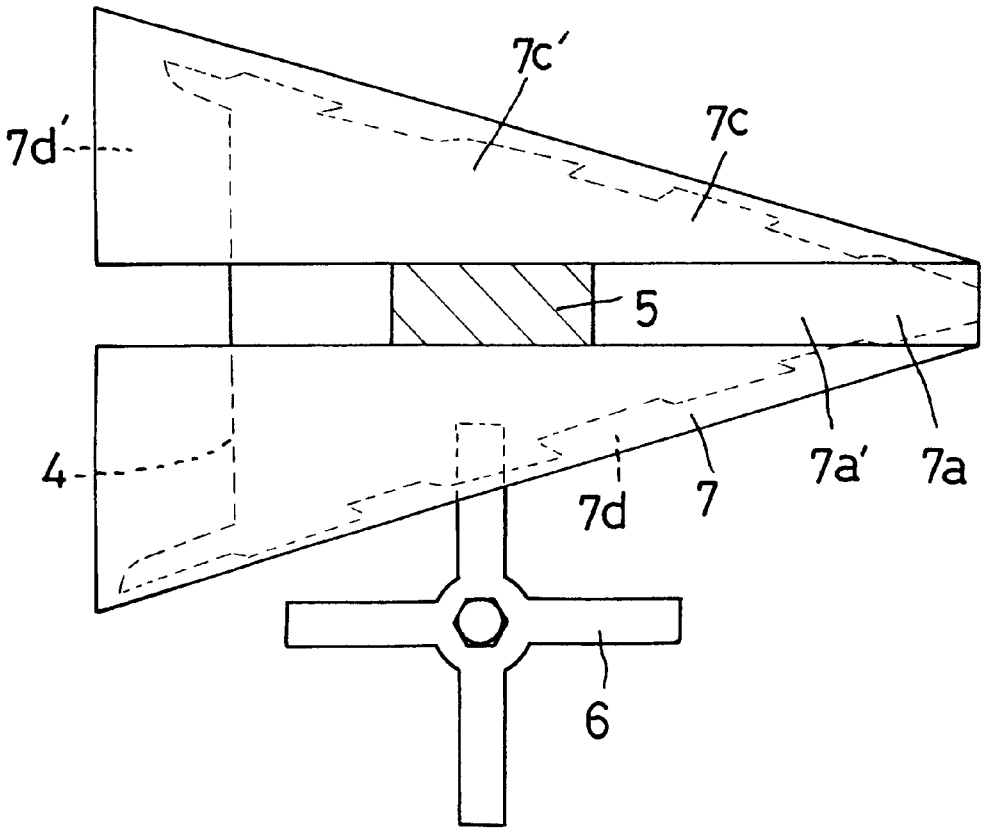
FIG. 7 is a partial plan view of a horizontal-type mixing apparatus of a first embodiment of the present invention.

For example, as shown in a first variation of FIG. 7, the changing surface 7*d*' can have a portion, which faces only a portion of the pulverizing member 6 in the radial direction of rotation partway through a rotation.

Figure 8:
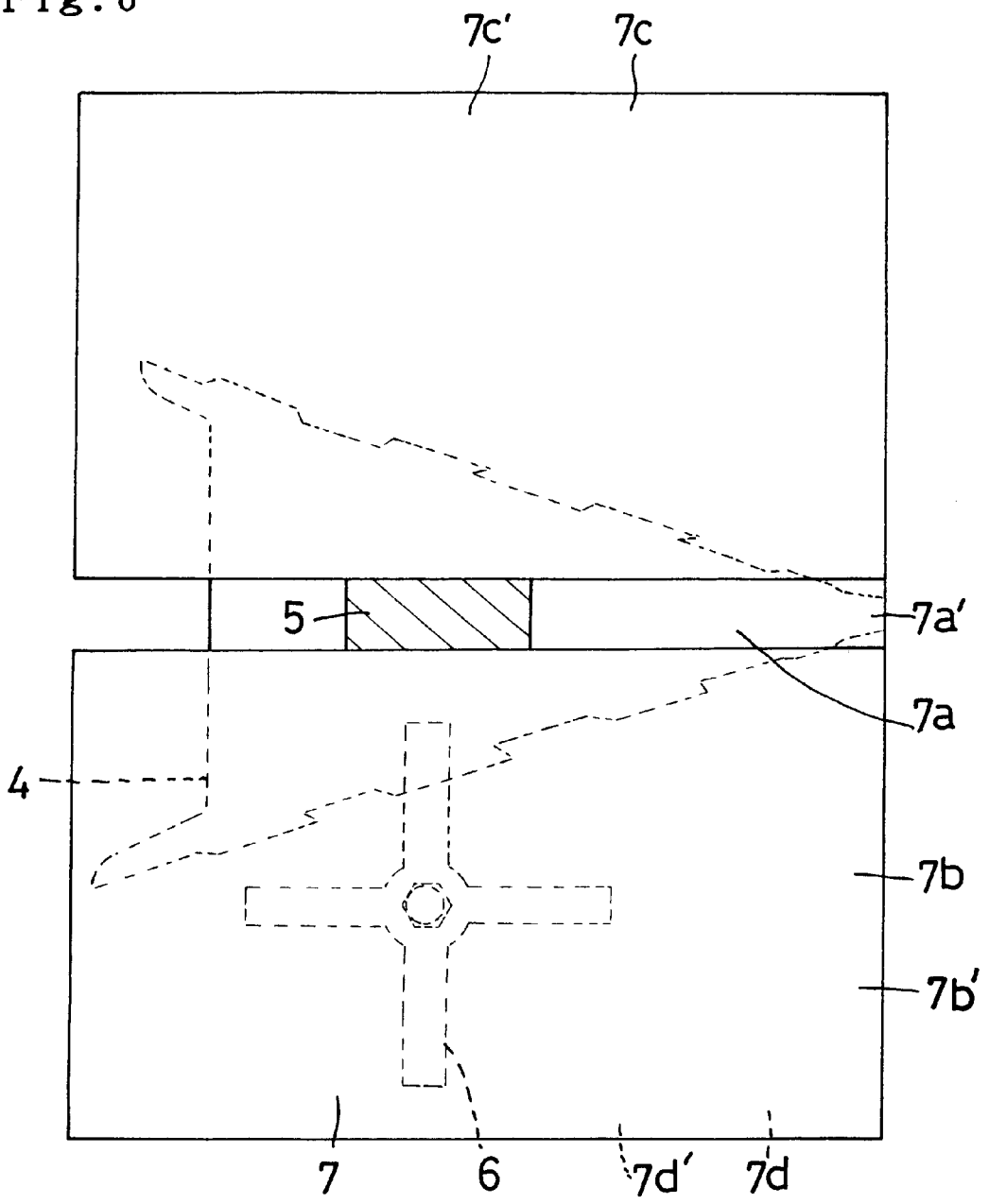
FIG. 8 is a partial plan view of a horizontal-type mixing apparatus of a second embodiment of the present invention.

Further, the dimensions of the changing surface 7*d*' in the axial direction of the rotating shaft 3 can gradually increase rearwardly of the direction of rotation from its front end to rear end, as shown in the first variation of FIG. 7, or can be constant in the overall area of the direction of rotation, as shown in a second variation of FIG. 8.

In the above embodiment, the flow direction-changing member 7 is mounted directly to the arm 5, but as shown in a third variation of FIG. 9 (1), (2), (3), the flow direction-changing member 7 can be mounted to an auxiliary arm 15, which protrudes from the arm 5 in the axial direction of the rotating shaft 3, and as indicated by the two-dot chain lines in FIG. 9 (2), the flow direction-changing member 7 can also be mounted to a second arm 16, which protrudes from the rotating shaft 3. In short, the flow direction-changing member 7 can be provided so as to be able to rotate together with the rotating shaft 3.

Further, it is not necessary for the changing surface 7*d*' to be provided in a location, in which it overlaps the stirring surface 4*a*', 4*b*', 4*c*' in the radial direction of the rotating shaft 3, but rather can be provided in a location, in which there exists material being mixed, which is flowing toward the outer circumference of the rotating shaft 3 in accordance with being stirred by the stirring surface 4*a*', 4*b*', 4*c*'. In the above embodiment, the changing surface 7*d*' constitutes a convex curved surface, which parallels a rotating body which is coaxial with the rotating shaft 3, but the shape is not particularly limited. For example, a flow direction-changing member 57 shown in a fourth variation of FIG. 10 (1), (2), (3), (4), has a plate-shaped top wall 57*a*, which is parallel to the axis of rotation of the rotating shaft 3, and a pair of plate-shaped side walls 57*b*, 57*c*, which are located on either side of an arm 5 in the axial direction of the rotating shaft 3, and the surfaces 57*b*', 57*c*' of the two side walls 57*b*, 57*c* constitute an auxiliary stirring surface similar to the above embodiment. The dimensions of each side wall 57*b*, 57*c* in the axial direction and radial direction of the rotating shaft 3 gradually increase rearwardly of the direction of rotation. The rear surface of each side wall 57*b*, 57*c* is connected to a pair of reinforcing plates 58 mounted to the arm 5, and reinforcing rods 59 protruding from the reinforcing plates 58 are connected to the side walls 57*b*, 57*c*. The back side surface 57*a*" of the top wall 57*a*, and the back side surfaces 57*b*", 57*c*" of each side wall 57*b*, 57*c* are used as a changing surface. Alternatively, a plate-shaped bottom wall can be provided outwardly from the two side walls 57*b*, 57*c* in the radial direction of rotation of the rotating shaft 3, and a flat changing surface can be provided on this bottom wall.

In the above-mentioned first through third variations, the other portions are the same as the above embodiment, and the same portions as the above embodiment are indicated by the same reference numerals.

In the above embodiment, one stirring member faces one flow direction-changing member, but one stirring member can face a plurality of flow direction-changing members, or a plurality of stirring members can face one flow direction-changing member.

In the above embodiment, the present invention applies to a horizontal-type mixing apparatus 1, but the present invention can also be applied to a vertical-type mixing apparatus, wherein the rotating shaft rotates around a vertical axis.

Figure 11:
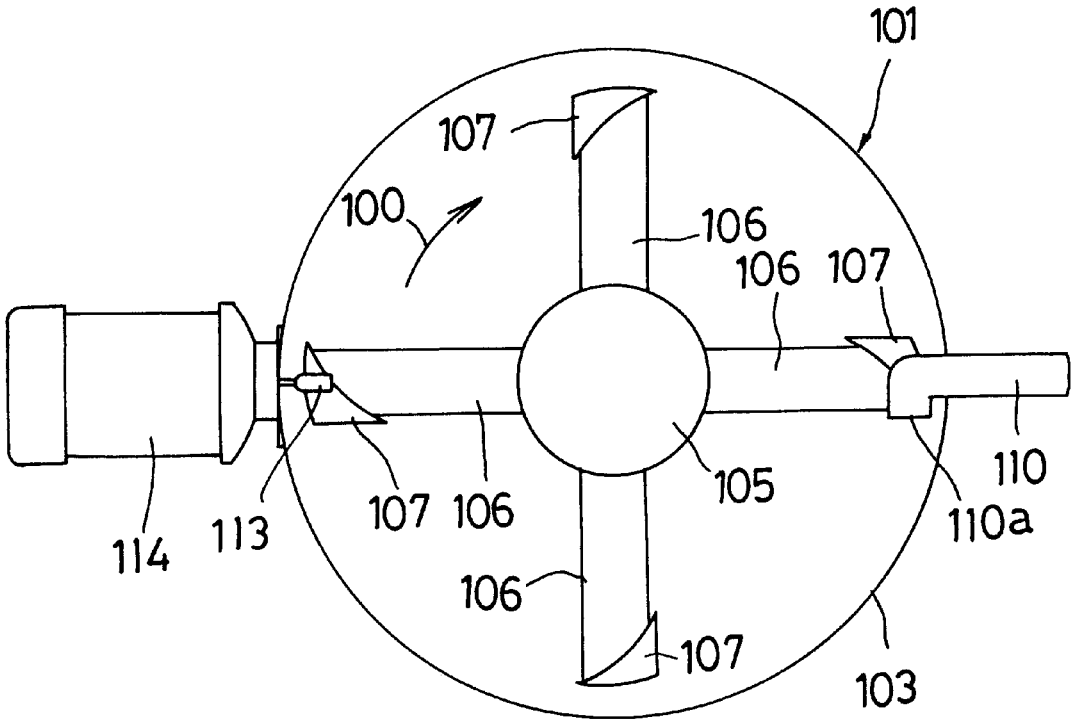
FIG. 11 is a plan view for illustrating the constitution of a vertical-type mixing apparatus of an embodiment of the present invention.
Figure 12:
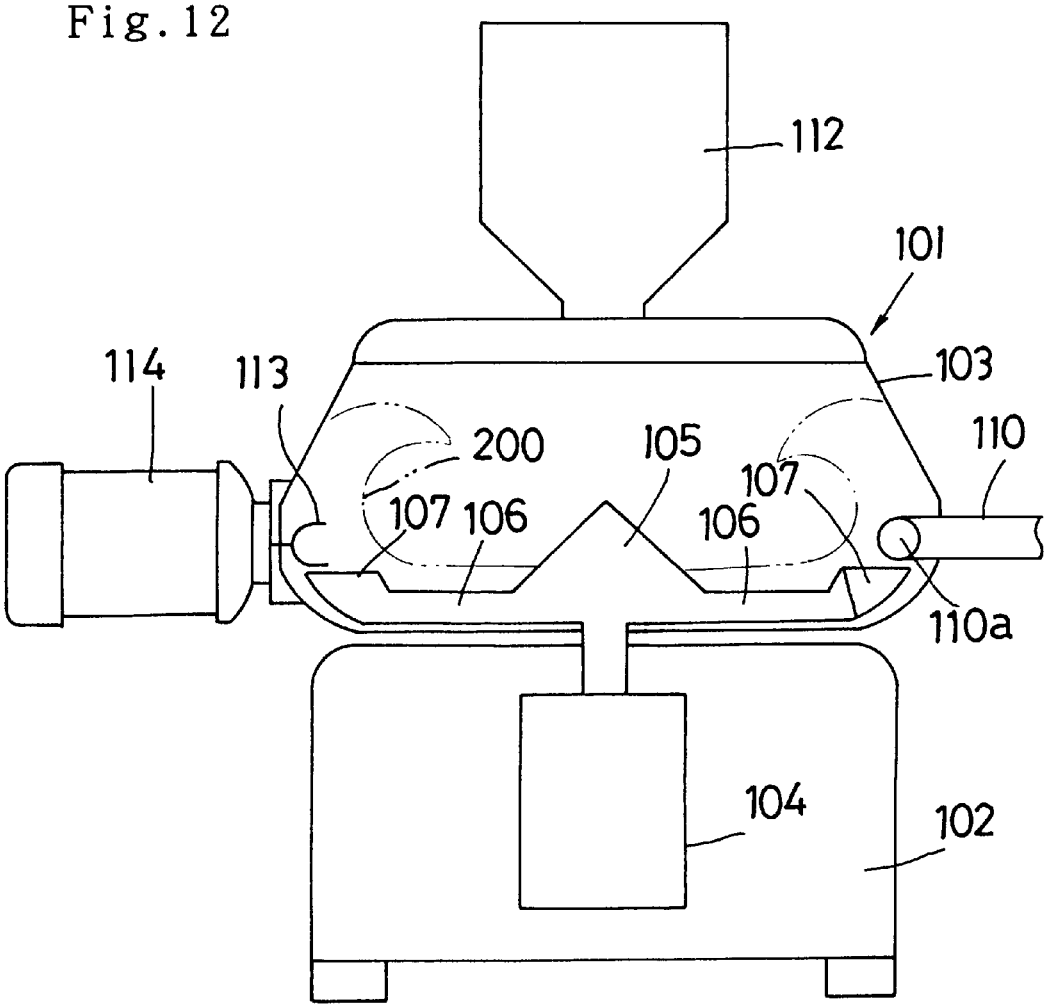
FIG. 12 is a side view for illustrating the construction of the vertical-type mixing apparatus of the embodiment of the present invention.

In the above embodiment, the present invention applies to a horizontal-type mixing apparatus 1, but the present invention can also be applied to a vertical-type mixing apparatus 101 as shown in FIG. 11 and FIG. 12, wherein the rotating shaft rotates around a vertical axis.

The vertical-type mixing apparatus 101 comprises a vessel 103, which is supported by a stand 102, and a rotating shaft 105, which is driven by a motor 104 in a rotating manner around a vertical axis inside the vessel 103. The inner circumference of the vessel 103 constitutes a curved surface, which parallels a rotating body which is coaxial with the rotating shaft 105. There are provided four arms 106, which protrude outwardly from the rotating shaft 105 in the radial direction of rotation. A stirring member 107 is integrated with the end of each arm 106. Each stirring member 107 stirs a material to be mixed contained in the vessel by rotating together with the rotating shaft 105 in the direction of arrow 100 in FIG. 11. The two-dot chain line 200 in FIG. 12 shows an example of the surface position of the material being mixed during mixing. A pipe 110 is provided for ejecting a gas used to condition the physical properties of the material being mixed into the inside of the vessel 103. The pipe 110 is inserted into the vessel 103, and secured to the vessel 103 via welding or some other well-known securing method so as to be arranged in a fixed location. A gas jet 110*a*, which is constituted of an opening at the end of the pipe 110, is provided in a fixed location relative to the vessel 103 so as to enable a gas to be ejected from within a material being mixed during mixing. In this embodiment, the gas jet 110*a* is arranged above the stirring member 107. The gas ejected via the gas jet 110*a* moves forwardly of the direction of rotation of the stirring member 4. An exhaust duct 112 for discharging the ejected gas is connected to the upper portion of the vessel 103. Further, a pulverizing member 113, which is capable of being driven in a rotating manner, is provided on the inner circumference of the vessel 103, which faces the outer circumference of the rotating shaft 3. The pulverizing member 113 is driven by a motor 114 in a rotating manner around a horizontal axis, pulverizing the material being mixed. The location of the pulverizing member 113 in the axial direction of the rotating shaft 105 corresponds to the location of the gas jet 110*a* in the axial direction of the rotating shaft 105.

According to the above vertical-type mixing apparatus 101, a gas is ejected from within the material being mixed during mixing, and is ejected forwardly of the direction of rotation of the stirring member, so that it is possible to lengthen the residence time of the gas inside the material being mixed, and to efficiently condition the physical properties of the material being mixed by the gas. Further, since the material being mixed can be made to flow toward the pulverizing member 113 by the gas, the material being mixed can be pulverized more efficiently.

What is claimed is:

1. An apparatus for mixing granular material of fine particle size which comprises:

a vessel for containing the granular material to be mixed;

a stirring member rotatably disposed within the vessel; and pipe means for ejecting a gas into the granular material for conditioning the physical properties of the granular material being mixed in the vessel, said pipe means having an open end portion which defines a gas jet, said open end portion being inclined relative to the horizontal plane so as to extend rearwardly of the direction of rotation of the stirring member and downwardly, the angle formed by the end portion of the pipe and the horizontal plane being less than the angle of repose of the material being mixed, wherein the gas jet is provided in a fixed location relative to the vessel so as to enable the gas to be ejected from within the material being mixed, and enable the gas to be ejected forwardly of the direction of rotation of the stirring member.

2. The apparatus for mixing granular material of fine particle size according to claim 1, wherein:

the stirring member is mounted on a rotating shaft which is driven in a rotating manner around a horizontal axis;

the inner circumference of the vessel constitutes a curved surface, which parallels and is coaxial with the rotating shaft; and the gas jet is arranged so that the ejected gas flows upwardly along the inner circumference of the vessel from the lower portion of the vessel.

3. The apparatus for mixing granular material of fine particle size according to claim 1, further comprising a pulverizing member provided to be drivable.

4. The apparatus for mixing granular material of fine particle size according to claim 1, further comprising means for supplying a liquid inside the vessel.

5. The apparatus for mixing granular material of fine particle size according to claim 4, wherein:

the liquid is supplied so as to move rearwardly of the direction of rotation of the stirring member.

6. An apparatus for mixing granular material of fine particle size which comprises:

a vessel for containing the granular material to be mixed;

a stirring member rotatably disposed within the vessel;

pipe means for ejecting gas into the granular material for conditioning the physical properties of the granular material being mixed in the vessel, said pipe means having an open end portion which defines a gas jet which is provided in a fixed location relative to the vessel so as to enable the gas to be ejected from within the material being mixed and enable the gas to be ejected forwardly of the direction of rotation of the stirring member;

means for supplying a liquid inside the vessel;

a dispersing member for dispersing the supplied liquid;

wherein the location of the dispersing member in the axial direction of the rotating shaft corresponds to the location of the gas jet in the axial direction of the rotating shaft.

* * * * *